US005678759A

United States Patent [19]

Grenci et al.

[11] Patent Number: 5,678,759

[45] Date of Patent: Oct. 21, 1997

[54] HEAT GENERATION THROUGH MECHANICAL MOLECULAR GAS AGITATION

[76] Inventors: Charles Albert Grenci, 205 Brown Rd., Montrose, Colo. 81401; R. Dallas Clayton, 200 Altez SE., Albuquerque, N. Mex. 87123

[21] Appl. No.: 92,778

[22] Filed: Jul. 19, 1993

[51] Int. Cl.[6] ..... F24D 1/00

[52] U.S. Cl. ..... 237/1 R; 34/92; 34/219; 126/247

[58] Field of Search ..... 34/15, 92, 23, 34/219, 410; 126/247; 237/1 R

[56] References Cited

U.S. PATENT DOCUMENTS

| | | | |
|---|---|---|---|
| 3,010,216 | 11/1961 | Ravet | 34/92 |
| 3,018,561 | 1/1962 | Wells | 34/559 |
| 3,467,179 | 9/1969 | Tevis et al. | 126/247 |
| 4,590,918 | 5/1986 | Kuboyama | 126/247 |
| 4,596,077 | 6/1986 | Kuboyama | 34/15 |
| 4,781,151 | 11/1988 | Wolpert et al. | 122/26 |
| 4,816,081 | 3/1989 | Mehta et al. | 34/410 X |
| 4,828,760 | 5/1989 | Chung et al. | 34/410 X |
| 5,046,480 | 9/1991 | Harris | 126/247 |
| 5,188,090 | 2/1993 | Griggs | 126/247 |
| 5,226,408 | 7/1993 | Drysdale | 126/247 |

OTHER PUBLICATIONS

HTS Air–Cooled Vacuum Pumping System product specification Leybold Vacuum Products, Inc.

Background literature on roots blower pumps.

*Primary Examiner*—Henry A. Bennett

*Assistant Examiner*—Dinnatia Doster

[57] ABSTRACT

Specifically configured gas compressors in a piping system will provide clean, gas heating and recirculation that will quickly and efficiently heat a connected process chamber or process piping section. Substantial heat is quickly generated through mechanical agitation of the gas molecules that pass through the inlet and outlet of a dual rotor-multiple lobe per rotor, rotary gas compressor. The application of a rotary gas compressor as a means of imparting heat to a gas stream provides an economical source of convective heat for closed and open loop piping applications.

23 Claims, 6 Drawing Sheets

HEAT GENERATION THROUGH MECHANICAL MOLECULAR GAS AGITATION

BACKGROUND OF THE INVENTION

1. Field of the Invention (Technical Field)

The present invention is directed to the discovery of a clean, gas heating and recimulating pumping system configuration that will quickly and efficiently heat a connected process chamber or process piping section. The useful application of the invention includes the removal of stubborn contaminants such as water vapor and hydrocarbons from the intemal surfaces of a process vacuum chamber or process piping system. The invention utilizes the substantial heat generated and subsequently imparted to gas molecules that are agitated as they pass through the inlet and outlet of a high throughput, dual rotor, multiple lobe per rotor, rotary gas compressor. There are a variety of rotary gas compressors that will parform the invention gas agitation/heating function, the most common being a dual rotor, two lobe rotor, roots type pump. The invention was developed using a dual rotor, three lobe rotor, rotary gas compressor although it is envisioned that there may be alternative pump geometries that will perform the invention functions even more efficiently. The heat generation through mechanical molecular gas agitation functions are; 1) Rapid agitation of gas molecules that pass through the inlet and outlet of the compressor/pump creating a substantial rise in gas temperature; 2) Rapid gas throughput to increase the frequency that the gas is agitated in a closed loop gas recirculation system; 3) Rapid gas agitation and subsequent gas temperature rise with a minimal delta pressure compression ratio between the compressor inlet and exhaust to minimize the amount of energy required to drive the compressor; 4) The ability to operate over a wide pressure range to cover both positive and vacuum pressure applications. The application of a rotary gas compressor to quickly and efficiently raise gas temperature will have broad application as an economical souroe of convective heat in closed loop piping, commercial convection ovens, process vacuum systems, positive/vacuum pressure dehydration applications, and water and space heating, 2. Background Art In order to generate convection heat, industry has relied on contact of a gas medium with a hot surface or flame. The heat imparted to the gas medium in this type of configuration is directly proportional to the amount of energy consumed to maintain the elevated temperature of the surface or the temperature of the flame that is in direct contact with the gas stream. Conversely, convection or gas contact heat has not been an energy efficient method to transfer heat to a surface due to the poor thermal transfer capability of gas in this type of heating configuration, although in special applications, such as the removal of certain types of contaminants such as molecular water vapor and hydrocarbon molecules from the intemal surfaces of a vacuum system, cycle purging with a heated purge gas has been an efficient method. The most common method to remove contamination has been the energy intensive application of external heat to the vacuum process chamber. This external heat baking to elevated temperatures as high as 400 degrees Fahrenheit is used in vacuum systems to reduce the dwell time of contaminants on the internal surfaces of a process system. The external baking is not always enough to provide successful removal of contamination. When conventional configurations rely on vacuum to remove contamination, the random motion of this molecular contamination in molecular flow vacuum conditions makes successful removal primarily a function of time. A successful prior art technique to reduce this time has been the introduction of a hot gas purge to sweep the inside surfaces of molecular contamination with a hot dry gas that will act as an effective transport mechanism for the contamination to the vacuum pumping subsystem. The effectiveness of the heated gas purge is improved through repeated purge cycles. In attempts to find a more efficient method to perform this hot gas purge function, it has been discovered the invention heat generation method using a rotary gas compressor to perform the molecular gas agitation function can very quickly impart heat to a gas stream more efficiently than traditional methods that utilize contact with a hot surface.

SUMMARY OF THE INVENTION

It has been discovered that certain rotary gas compressors can impart a significant amount of heat to the gas molecules that pass from the inlet of the pump to the outlet. The addition of a gas recirculation valve makes it possible to quickly and efficiently impart heat to a gas stream as it is recirculated though the compressor. When this invention is connected to a process vacuum chamber at a process vacuum chamber evacuation port and recirculation port, the heat generated by a dual rotor, three lobe rotor, compressor quickly elevates the temperature of a purge gas as it flows from the compressor inlet to the compressor outlet through the process vacuum chamber and associated system piping in a recirculating fashion that sweeps the internal surfaces of the system with hot purge gas to provide rapid removal of contamination from the internal surfaces of the vacuum system so that it can be effectively pumped away by the vacuum pump subsystem. It has been found that dual rotor—gas boosters will impart a great deal of heat energy to the gas molecules that pass through the booster through the control of three basic parameters; a) The gas pressure/molecular density inside the pump; b) Increasing the dwell time of the molecules inside the pumping mechanism by restricting the flow of gas at either the pump inlet, the pump outlet or both; c) The frequency that the gas molecules pass through the pumping mechanism in recirculation operation. It should be noted that these parameters are easily controlled and that the pump application performs the molecular gas agitation/heat generation, hot gas stream recirculation and system evacuation functions as a single component in a simple system configuration. This simple recirculation configuration, through the adjustment of these parameters may prove to be a more efficient and economical source of heat generation than recirculated hot water or air that is heated though contact with an electrical resistance heated surface.

BRIEF DESCRIPTION OF THE DRAWINGS

The accompanying drawings, which are incorporated into the specification, help to illustrate the preferred embodiment of the invention and are not to be construed as limiting the invention.

DESCRIPTION OF THE PREFERRED EMBODIMENTS

Figure 1:
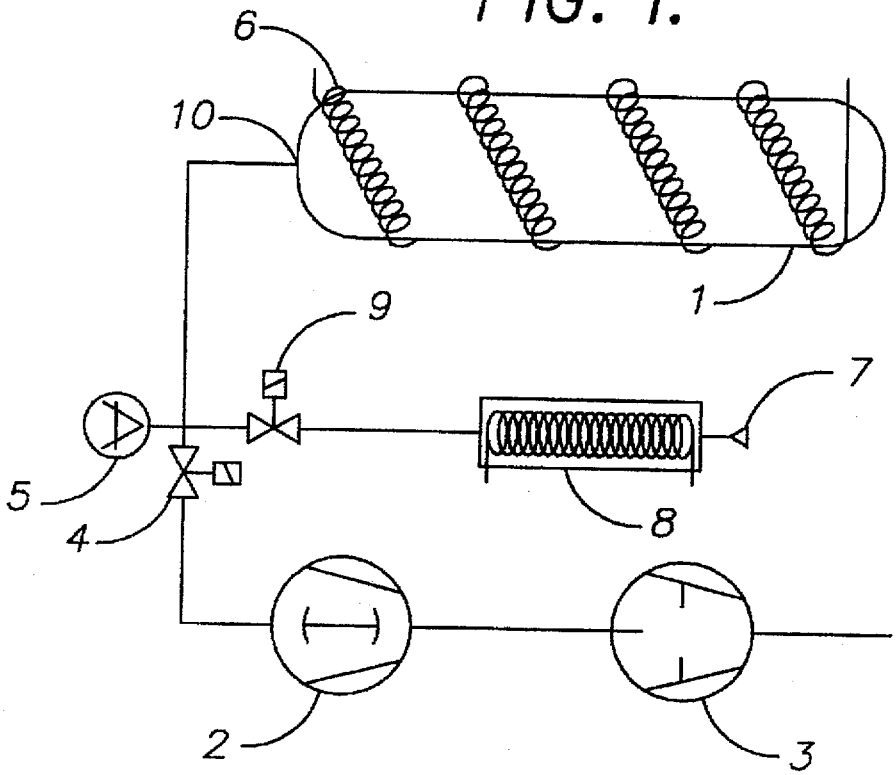
FIG. 1 is a schematic of a typical prior art, medium vacuum pumping configuration to remove internal surface contamination. The configuration comprises a vacuum process chamber with an external electrical heating jacket, a heated purge gas inlet, a vacuum gauge sensor, a first stage rough vacuum pump and a second stage dual rotor—three lobe rotor gas compressor.

Referring to FIG. 1, a typical, prior art, medium vacuum pressure system that is externally heated and internally purged with hot gas is shown to illustrate the components that are used in the construction of prior art systems that are designed to remove internal surface contamination from the process vacuum chamber and associated pipe work. The illustration of the system is intended to aid understanding of the present invention. The prior art system example comprises a process vacuum chamber 1 that is heated by an external electdc baking jacket 6. The Process vacuum chamber 1 is connected to a two stage, medium vacuum pressure pumping subsystem. The example subsystem comprises a first stage rough vacuum pump 3, and a second stage dual rotor—three lobe rotor vacuum compressor 2. The subsystem is connected to the process vacuum chamber 1 by a piping manifold that includes a vacuum gauge sensor 5 to measure the total vacuum pressure level achieved by the first and second stage vacuum pumps, a second stage medium vacuum pressure isolation valve 4, and a purge gas inlet valve 9. In addition to the external electric baking jacket 6, the system configuration includes an electdc purge gas heater 8 that will elevate the temperature of the purge gas 7 to further assist the removal of contamination from the internal surfaces of the example vacuum system. The application of external heat is intended to desorb molecular level contamination from the internal surfaces of the vacuum system so that they can be pumped by the vacuum pumping subsystem. The most common and persistent type of contamination in vacuum applications is molecular water vapor. This type of contamination is very difficult to remove by vacuum pumping. To better remove water vapor contamination the addition of the hot gas purge will help to sweep the inside surfaces of molecular water vapor with a hot dry gas that will act as an effective transport mechanism for the water vapor contamination to the vacuum pumping subsystem. The effectiveness of the heated gas purge is improved through repeated purge cycles.

Figure 2:
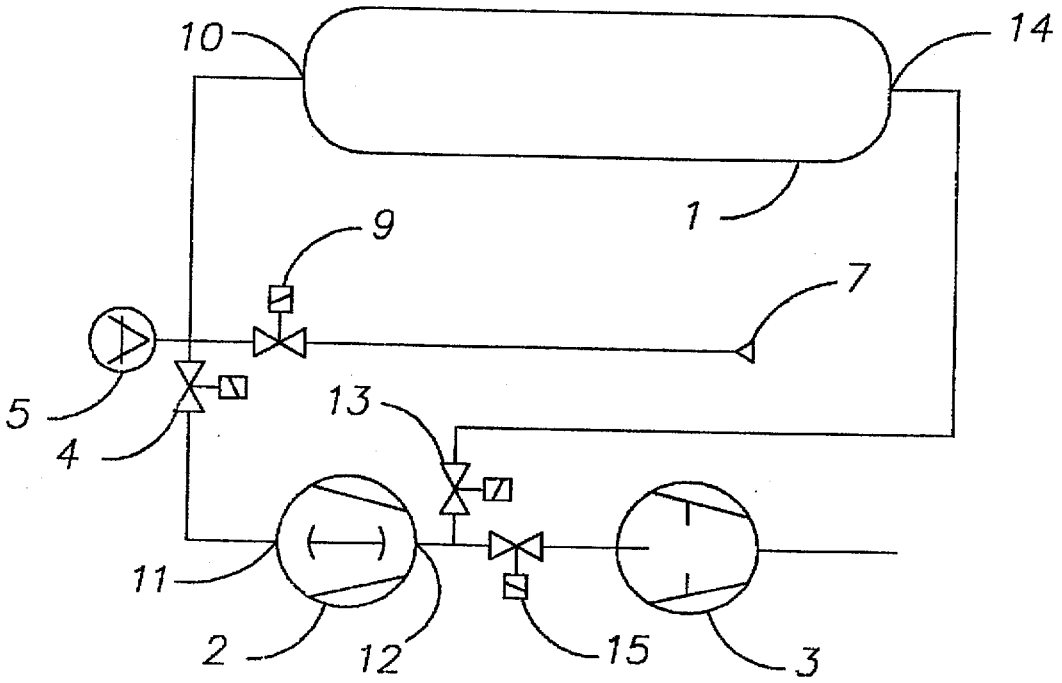
FIG. 2 is a medium vacuum system that incorporates the invention gas recirculation method to remove internal surface contamination.

Referring to FIG. 2, a medium vacuum pressure system that has been modified with the gas recirculation configuration is shown to illustrate the components that are used in the construction of a vacuum system that utilizes the present invention to remove internal surface contamination from the process vacuum chamber and associated pipe work. The invention system example comprises a process vacuum chamber 1 that is connected to a two stage, medium vacuum pressure pumping subsystem. The example subsystem comprises a first stage rough vacuum pump 3, and a second stage dual rotor—three lobe rotor vacuum compressor 2. The subsystem is connected to the process vacuum chamber 1 by a piping manifold, that includes a vacuum gauge sensor 5 to measure the total vacuum pressure level achieved by the first and second stage vacuum pumps, a second stage medium vacuum pressure isolation valve 4, and a purge gas inlet valve 9. The addition of a gas recirculation valve 13, connected to the process vacuum chamber 1 at the process vacuum chamber recirculation port 14, and a first stage rough vacuum isolation valve 15 provides the ability to utilize the heat generated by the second stage dual rotor—three lobe rotor vacuum compressor 2 to elevate the temperature of the purge gas 7 as it flows from the vacuum compressor inlet 11 to the vacuum compressor outlet 12 through the process vacuum chamber 1 and associated system piping in a recirculating fashion that sweeps the internal surfaces of the system with hot dry purge gas to provide rapid removal of contamination from the internal surfaces of the example vacuum system so that it can be effectively pumped away by the vacuum subsystem.

Figure 3:
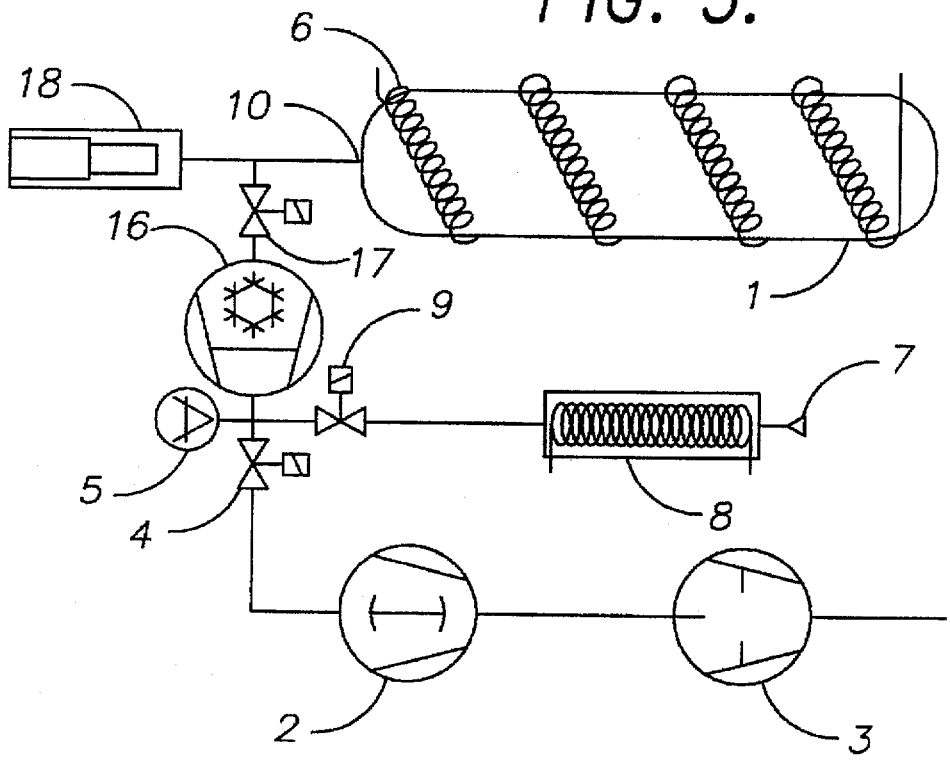
FIG. 3 is a schematic of a prior art, high vacuum pumping configuration to remove internal surface contamination. The configuration comprises a vacuum process chamber with an external electrical heating jacket, a heated purge gas inlet, a vacuum gauge sensor, a first stage rough vacuum pump, a second stage dual rotor gas compressor and a cryogenic capture pump.

Referring to FIG. 3, a typical, prior art, high vacuum pressure system that is extemally heated and internally purged with hot gas, is shown to illustrate the basic components that are used in the construction of prior art systems that are designed to remove internal surface contamination from the process vacuum chamber and associated pipe work. The illustration of the system is intended to aid understanding of the present invention. The prior art system example comprises a process vacuum chamber 1 that is heated by an external electric baking jacket 6. The process vacuum chamber 1 is connected to a three stage, high vacuum pressure pumping subsystem. The example subsystem comprises a first stage rough vacuum pump 3, a second stage dual rotor—three lobe rotor vacuum compressor 2 and a high vacuum cryogenic capture pump 16. The subsystem is connected to the process vacuum chamber 1 by a piping manifold, that includes a residual gas analysis sensor 18 to measure partial vacuum pressure contamination levels and to measure the total vacuum pressure achieved by the high vacuum cryogenic capture pump 16, a third stage high vacuum isolation valve 17, a vacuum gauge sensor 5 to measure the total vacuum pressure level achieved by the first and second stage vacuum pumps, a second stage medium vacuum pressure isolation valve 4, and a purge gas inlet valve 9. In addition to the external electric baking jacket 6, the system configuration includes an electric purge gas heater 8 that will elevate the temperature of the purge gas 7 to further assist the removal of contamination from the internal surfaces of the example vacuum system. The application of external heat is intended to desorb molecular level contamination from the internal surfaces of the vacuum system so that they can be pumped by the vacuum pumping subsystem. The most common and persistent type of contamination in vacuum applications is molecular water vapor. This type of contamination is very difficult to remove by vacuum pumping. Although the cryogenic type pump used in this example is the most efficient pump for this purpose, it is difficult in many systems to transport the water vapor to the pump efficiently. To better remove water vapor contamination, the addition of the hot gas purge will help to sweep the inside surfaces of molecular water vapor with a hot dry gas that will act as an effective transport mechanism for the water vapor contamination to the vacuum pumping subsystem. The effectiveness of the heated gas purge is improved through repeated purge cycles.

Figure 4:
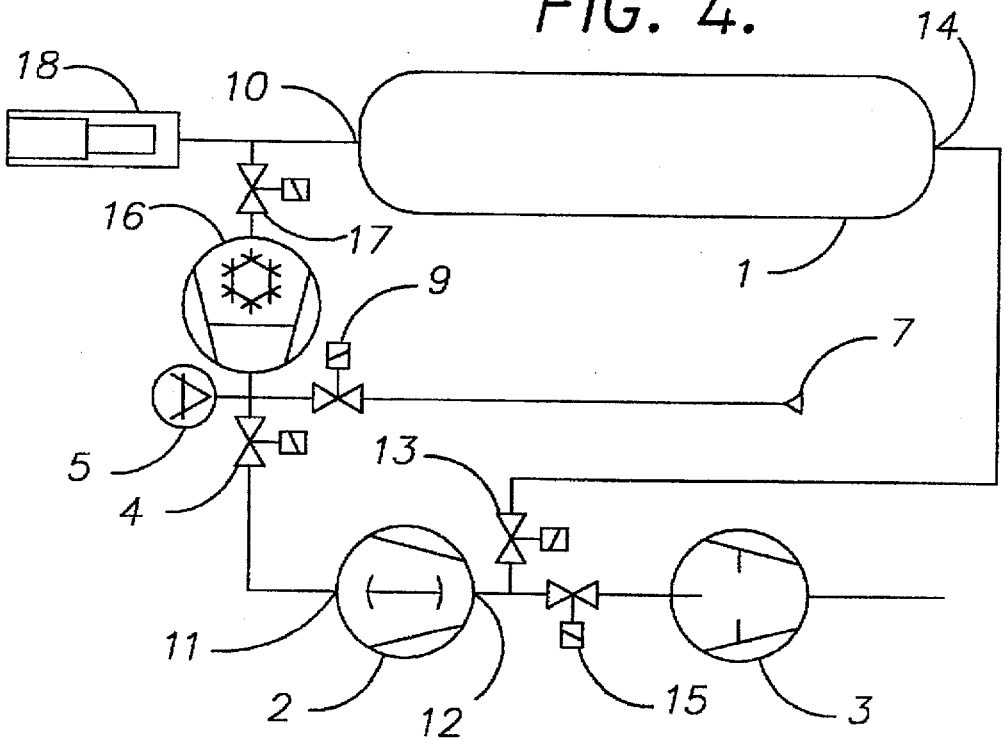
FIG. 4 is the high vacuum system of FIG. 3 that has been modified to incorporate the invention gas recirculation method to remove internal surface contamination.

Referring to FIG. 4, a high vacuum pressure system that has been modified with the gas recirculation configuration is shown to illustrate the components that are used in the construction of a vacuum system that utilizes the present invention to remove internal surface contamination from the process vacuum chamber and associated pipe work. The invention system example comprises a process vacuum chamber 1 that is connected to a three stage, high vacuum pressure pumping subsystem. The example subsystem comprises a first stage rough vacuum pump 3, a second stage dual rotor—three lobe rotor vacuum compressor 2, and a high vacuum cryogenic capture pump 16. The subsystem is connected to the process vacuum chamber 1 by a piping manifold, that includes a residual gas analysis sensor 18 to measure partial vacuum pressure contamination levels, a third stage high vacuum isolation valve 17, a vacuum gauge sensor 5, to measure the total vacuum pressure level achieved by the first and second stage vacuum pumps, a second stage medium vacuum pressure isolation valve 4, and a purge gas inlet valve 9. The addition of a gas recirculation valve 13, connected to the process vacuum chamber 1 at the process vacuum chamber recirculation port 14, and a first stage rough vacuum isolation valve 15 provides the ability to utilize the heat generated by the second stage dual rotor—three lobe rotor vacuum compressor 2 to elevate the temperature of the purge gas 7 as it flows from the vacuum compressor inlet 11 to the vacuum compressor outlet 12 through the process vacuum chamber 1 and associated system piping in a recirculating fashion that sweeps the internal surfaces of the system with hot dry purge gas to provide rapid removal of contamination from the internal surfaces of the example vacuum system so that it can be effectively pumped away by the vacuum subsystem. In this configuration, the recirculated gas acts as an efficient transport mechanism for molecular water vapor contamination that is then easily condensed and trapped by the ultra cold surfaces of the cryogenic pump.

Figure 5:
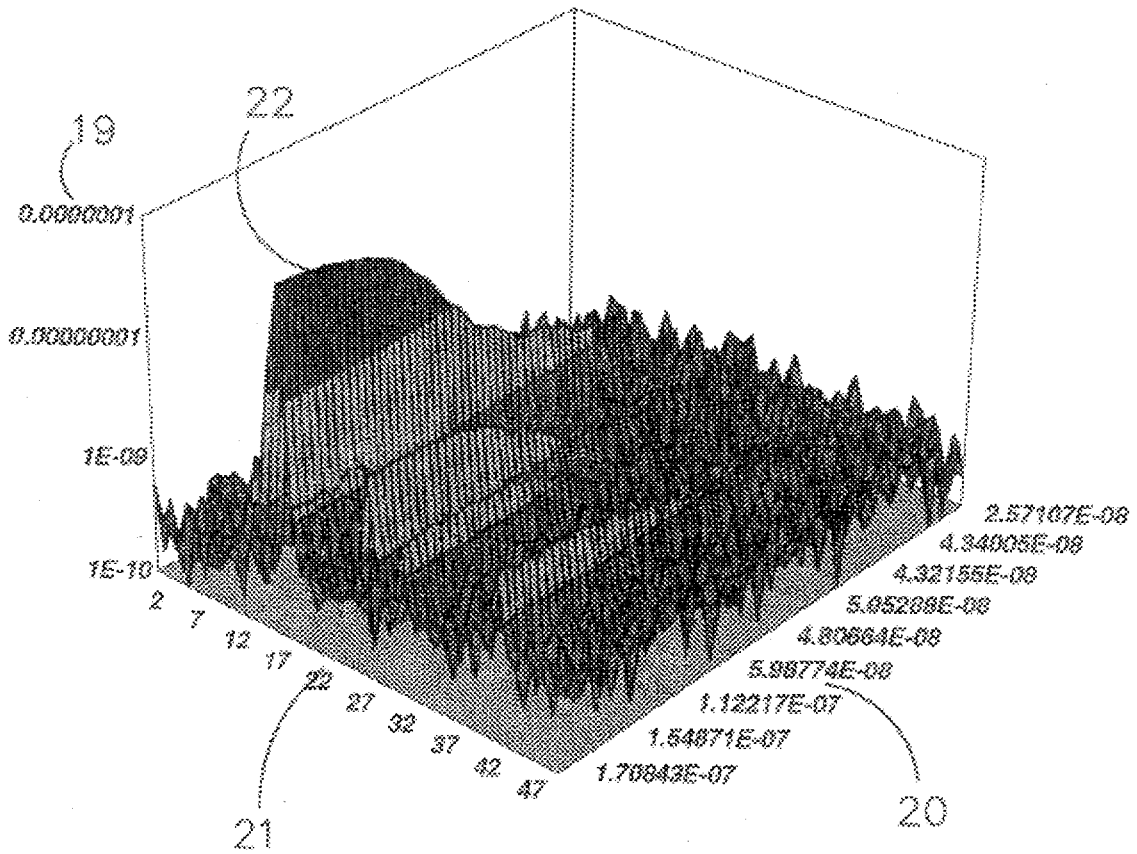
FIG. 5 is a three dimensional surface, residual gas analysis chart that shows a quick reduction of background water vapor contamination in a high vacuum chamber using the invention gas recirculation vacuum pumping system.

Referring to FIG. 5, a three dimensional surface, residual gas analysis chart is shown that is comprised of a partial vacuum pressure in Torr units—Z scale 19, a total vacuum pressure in Torr units—X scale 20, and an Atomic Mass units—Y scale 21. The data set shows a 45,000% improvement in the partial pressure level readings for Atomic Mass unit 18—H20 vapor molecules 22. This data was gathered by connecting a high vacuum pumping system that was configured, as shown in FIG. 4, to a complex shaped high vacuum piping system containing 11 ea. 4" diameter straight sections 67" in length, 32 ea. 4" elbows, 18 ea. 4" diameter straight sections 83" in length, 12 ea. 4" crosses, and 40 ea. 4" diameter straight sections 4" in length. The total internal volume of the piping system was 23.6 cubic feet, and the total internal surface area equaled 283 square feet. The piping system was evacuated to 0.003 Torr using a Nuvac model NDP—70 two stage oil free pumping system Ser. No. 022292 modified as shown in FIG. 4 by opening both the third stage high vacuum isolation valve and the second stage medium vacuum pressure isolation valve. The second stage isolation valve was then closed and the purge valve was opened until the vacuum pressure in the piping system reached 600 Torr. The second stage isolation valve was then opened until the piping system was evacuated to 400 Torr, at which point the first stage isolation valve was closed and the gas recirculation valve was opened. The gas inside the piping system was recirculated for 5 minutes which elevated the temperature of the gas to 200 degrees F. The first stage rough vacuum isolation valve was then opened until the pressure in the piping system reached 0.01 Torr, at which point the CTI On—Board 8, cryogenic capture pump serial number AD119939 compressor was started and subsequent cool down of the cryogenic pump began. Gas molecules were recirculated by the second stage dual rotor—three lobe rotor compressor until the temperature of cryogenic capture pump reached 50 degrees Kelvin at which point the second stage medium pressure isolation valve and the gas recirculation valve were closed. When the cryogenic capture pump reached its base temperature of 10 degrees Kelvin, the RGA emissions were turned on and the RGA was allowed to warm up for 20 minutes. The data set in this FIG. shows the spectral data gathered for the next 1.5 hours. The RGA used to collect this data was an MKS model number 600A PPT, Ser. No. 1251-9201.

Figure 6:
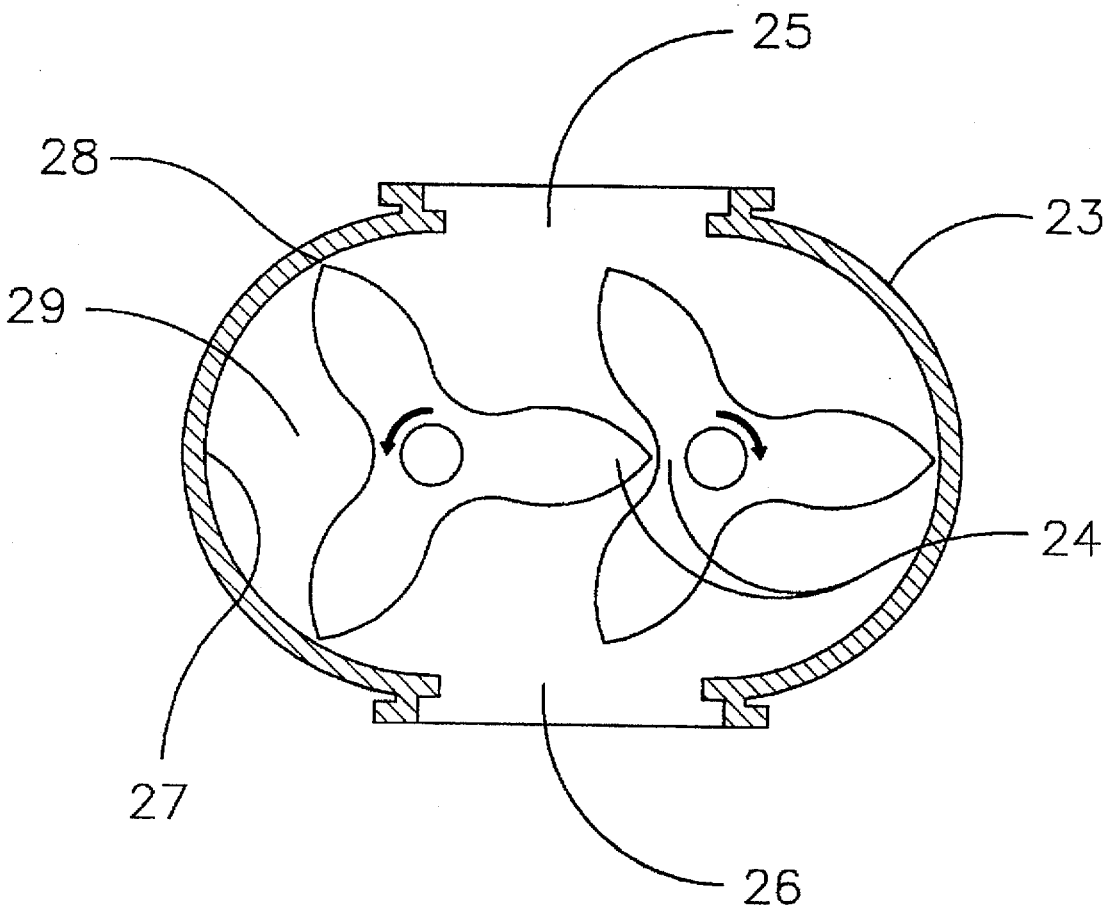
FIG. 6 is a cutaway view of a dual rotor—multiple lobe rotor—gas compressor to illustrate how the operation of this type of pumping mechanism imparts heat to the gas molecules that pass through the pump.

Referring to FIG. 6, a cutaway view of a dual rotor—three lobe rotor gas compressor 23 is shown to illustrate how this type of pump imparts heat to the gas molecules that enter the compressor inlet 25 and aro then trapped in a gas pocket 29 formed between the rotor lobes tips 28 and the pump stator inside diameter 27. As the synchronized rotors travel in opposite directions, the formed gas pockets aro expelled at the compressor outlet 26. The close tolerance, intermeshing rolationship of the rotor tips and opposite rotor valleys 24 and the pump stator inside diameter 27, prevents significant leakage of gas molecules from the compressor outlet 26 and the compressor inlet 25 yet creates significant agitation of the gas molecules inside the pump. It has been found that this type of pumping mechanism can impart a great deal of heat energy to the gas molecules that pass through the mechanism by controlling three basic parameters; a) The gas prossuro/molecular density inside the pump. b) Increasing the dwell time of the molecules inside the pumping mechanism by restdcting the flow of gas at either the pump inlet, the pump outlet or both. c) The frequency that the gas molecules pass through the pumping mechanism in recirculation operation. It should be noted that these parameters are easily controlled and that the compressor performs the heat generation, hot gas molecule recirculation and evacuation functions as a single component in a simple system configuration. This simple recirculation configuration, through the adjustment of these parameters may prove to be a more efficient and/or economical source of heat in certain applications than recirculated hot water or air that is heated though contact with a hot surface.

Figure 7:
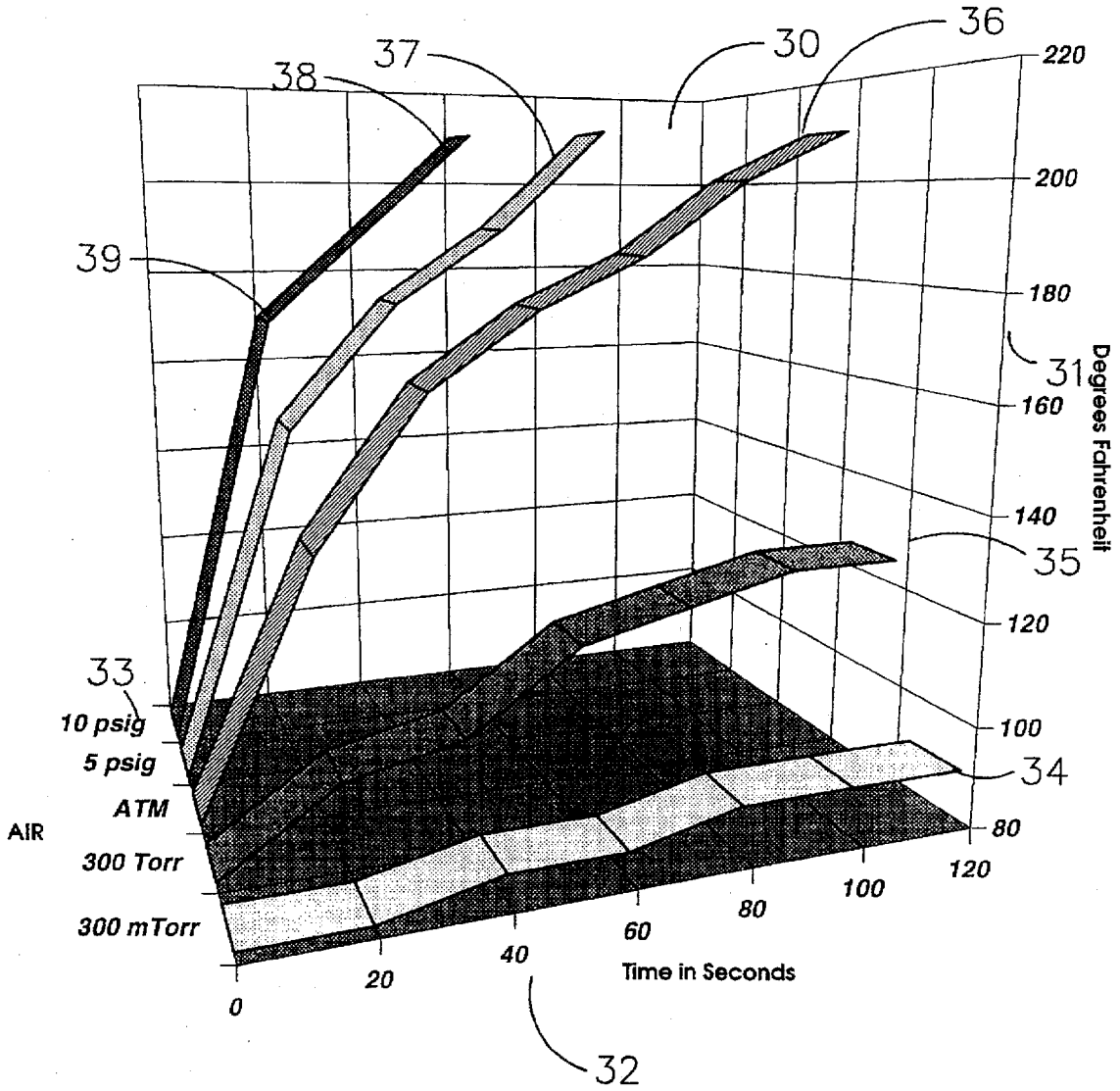
FIG. 7 is a three dimensional line graph that shows the effect of gas pressure/molecular density on the invention heat generation efficiency. This test was performed using the invention configuration shown in FIG. 2.

Referring to FIG. 7, a three dimensional line chart 30 is shown that is comprised of a gas Fahrenheit temperature Z scale 31, a Time in seconds X scale 32, and a compressor inlet gas pressure Y scale 33. The data set shows a 233% improvement in heat generation through mechanical molecular gas agitation between operation at 300 mTorr for 120 seconds 34 and operation at 10 psig for sixty seconds 39 or half the amount of time. In the comparison of these graph lines it should be noted that operation at 300 mTorr consumed 5.5 amps of 440 volts 3 phase AC electrical power and operation at 10 psig consumed 8 amps of 440 volts 3 phase AC electrical power. Additional data points that cover gas Fahrenheit temperature versus time and pressure are:

300 Torr operation for 120 seconds 35, atmospheric pressure (640 Torr in the test location altitude) for 120 seconds 36, 5 psig operation for 120 seconds 37 and 10 psig for 20 seconds 39 are shown to further illustrate the relationship of gas molecular density to the invention heat generation potential. The electrical energy used at these pressures is 5.5 amps at 300 Torr, 6.5 amps at atmospheric pressure (640 Torr) and 7 amps at 5 psig. These energy requirements show a marked increase in the invention heat generation potential based on gas molecular density as a function of pressure, with a relatively small increase in energy consumption. This highly efficient relationship is due to the discovery that certain gas compressor geometries energy consumption is primarily a function of the delta pressure between the pump inlet and outlet and that the geometries will generate a high delta temperature between the inlet and outlet without generating a high delta pressure. Furthermore, increasing the inlet gas pressure actually reduces the delta pressure ratio between the compressor inlet and outlet due to a shortened molecular mean free path which reduces the compression ratio efficiency. With the compressor geometry, a high inlet gas pressure/short molecular mean free path reduces the compression ratio efficiency of the compressor and ccompressor and creates a lower inlet/outlet delta pressure. When the compressor is operated in the recirculating configuration, the reduced compression ratio efficiency and delta pressure relationship at higher inlet gas pressure helps to reduce the amount of energy required to operate the compressor at the higher pressure. The three dimensional line chart 30 in this figure clearly shows that with the heat generation through mechanical molecular gas agitation, reduced compression ratio efficiency creates increased heat generation efficiency which indicates that the heat that is imparted to the gas stream is not due to basic heat of compression but rather the agitation of the gas molecules as they pass through the pump.

Figure 8:
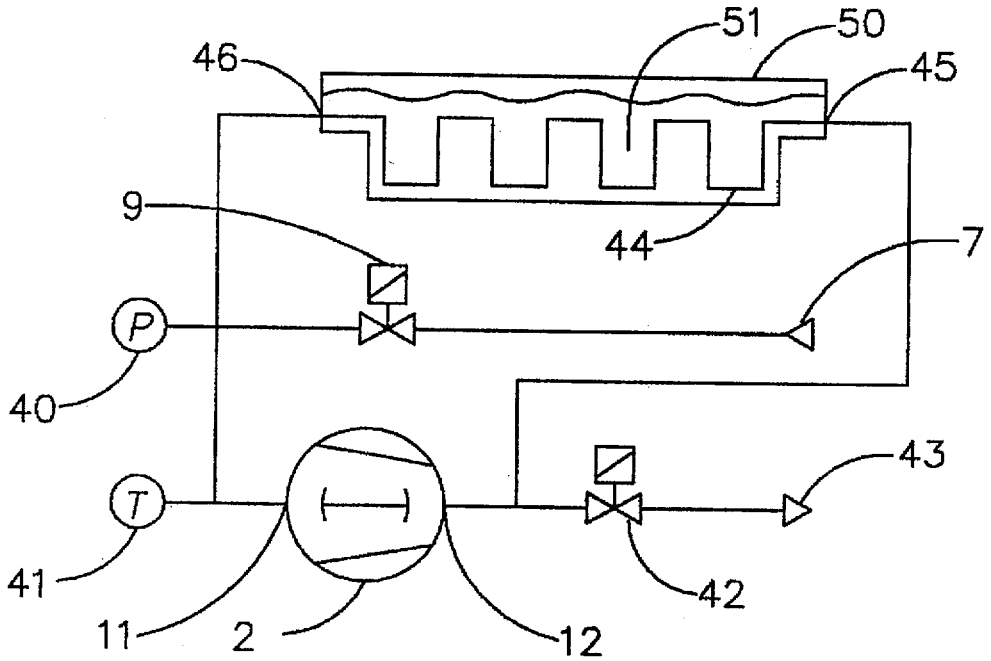
FIG. 8. is a schematic of the invention used to transfer heat to a fluid inside of a holding tank.

Referring to FIG. 8, a heat generation configuration to transfer heat to a process fluid 51 inside a process fluid container 50 is shown to illustrate use of the invention as an effective means of heat transfer to a liquid using a closed loop heat exchanger 44, that has a heat exchanger Inlet 45 and heat exchanger outlet 46 for connection to the gas recirculation system. The gas recirculation system example comprises a dual rotor—three lobe rotor compressor 2 that is connected to the heat exchanger by a piping manifold, that includes a pressure gauge sensor 40 to measure recirculating gas inlet pressure, a purge gas inlet valve 9 to increase recirculation gas pressure, a temperature gauge sensor 41 to measure recirculating gas inlet temperature and purge gas outlet valve 42 to reduce recirculation gas pressure. Operation of the compressor quickly elevates the temperature of the gas charge inside the piping of the purge gas 7 as it flows from the compressor inlet 11 to the Compressor outlet 12 through the associated system piping in a recirculating fashion that efficiently transfers heat to the process fluid 51. Heat generation in the example is simply controlled through adjustment of gas charge pressure, compressor operating speed, or both.

Figure 9:
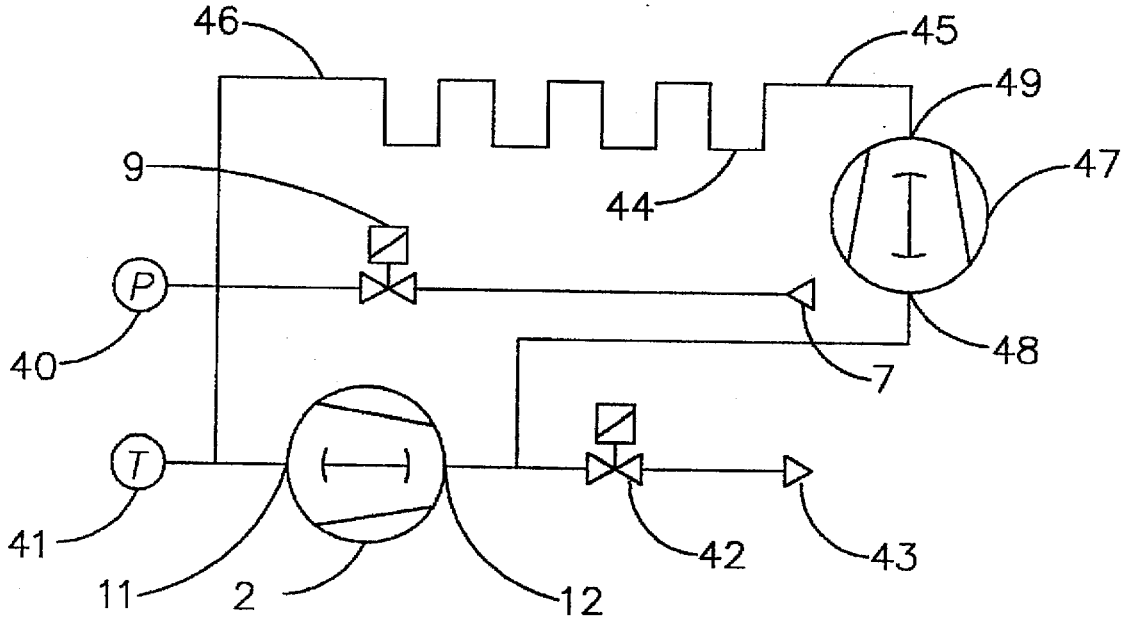
FIG. 9 is a schematic of the invention used to transfer heat to a space using multiple gas compressore in series to provide increased heat generation through increased frequency of gas stream recirculation/molecular gas agitation.

Referring to FIG. 9, a heat generation configuration to transfer heat to a space is shown to illustrate use of the invention as an effective means of this type of heat transfer. The gas recirculation system example comprises a primary dual rotor—three lobe rotor compressor 2, and a secondary dual rotor—three lobe rotor compressor that are connected to the closed loop heat exchanger 44 at the heat exchanger inlet 45 and the heat exchanger outlet 46 by a piping manifold, that includes a pressure gauge sensor 40 to measure recirculating gas inlet pressure, a purge gas inlet valve 9 to increase recirculation gas pressure, a Temperature gauge sensor 41 to measure recirculating gas inlet temperature and Purge gas outlet valve 42 to reduce recirculation gas pressure. Operation of the compressors quickly elevates the temperature of the gas charge inside the piping of the purge gas 7 as it flows from the primary compressor inlet 11 to the primary compressor outlet 12 and from the secondary compressor inlet to the secondary compressor outlet 49 through the associated system piping in a recirculating fashion that efficiently transfers heat to the process fluid 51. Heat generation in the example is simply controlled through adjustment of gas charge pressure, compressor operating speeds, or both.

What we claim is:

1. In a vacuum-pressure system comprising a vacuum chamber having an access-opening; a pumping system coupled to said access opening of said vacuum chamber for creating vacuum pressure in said vacuum chamber, said pumping system comprising at least one pump having an intake and an exhaust; first conduit means for coupling said pumping system to said access-opening of said vacuum chamber, said first conduit means having a first, isolating valve means coupled to said pumping system; means for injecting purge gas into said vacuum-pressure system in order to remove contamination from the interior of said vacuum chamber, said means for injecting purge gas comprising second conduit means for directing the purge gas into said vacuum-pressure system, said second conduit means having a second, isolating valve means for controlling the flow of the purge gas into said system, wherein the improvement comprises: a third, isolating valve means coupled to said exhaust of said at least one pump, and a fourth, gas-recirculation valve means coupled between said exhaust of said at least one pump and said vacuum chamber, whereby the purge gas may be recirculated through the vacuum chamber and said at least one pump a plurality of times. whereby said purge gas is heated by said at least one pump in order to remove contamination from the interior of the vacuum chamber;

said fourth, gas-recirculating valve means comprising a gas-recirculating valve and third conduit means; said vacuum chamber comprising a second access-opening: said third conduit means having an end in fluid communication with said second access-opening of said vacuum chamber; said gas-recirculating valve means controlling the flow through said third conduit means and, therefore, the flow of purge gas into said second access-opening of said vacuum chamber.

2. The vacuum-pressure system according to claim 1, wherein said at least one pump comprises a rotary gas compressor.

3. The vacuum-pressure system according to claim 2, wherein said rotary gas compressor comprises a dual, multi-lobe rotor, roots-type pump.

4. The vacuum-pressure system according to claim 1, wherein said first, isolating valve means is coupled to said intake of said at least one pump, said second, isolating valve means being coupled to a portion of said first conduit-means at a location upstream of said first, isolating valve means, so that first isolating valve means may isolate the purge gas to cause it to flow into said access-opening of said vacuum chamber.

5. The vacuum-pressure system according to claim 1, wherein said third, isolating valve means is coupled to the exhaust of said at least one pump; said fourth, gas-recirculation valve means being coupled to said exhaust of said at least one pump upstream of said third, isolating valve means, whereby, when said third, isolating valve means is closed, and said fourth, gas-recirculation valve means is open, the purge gas may be allowed to recirculate through the vacuum chamber.

6. The vacuum-pressure system according to claim 1, wherein said vacuum-pressure system is a medium, vacuum-pressure system, said pumping system comprising a first-stage pump and a second-stage pump, said first conduit means coupling the intake of said second-stage pump to said access-opening of said vacuum chamber, said first isolating valve means controlling the flow between said second-stage pump and said accessopening of said vacuum chamber.

7. The vacuum-pressure system according to claim 1, wherein said vacuum-pressure system is a high vacuum pressure system, said pumping system comprising a first-stage pump, a second-stage pump, and a third-stage, high-vacuum pump; said first, isolating valve means being located between the inlet of said third-stage, high-vacuum pump and said access opening of said vacuum chamber; and a fifth, isolating valve means located between the outlet of said third-stage pump and the inlet of said second-stage pump; said second, isolating valve means also being coupled to the outlet of said third-stage pump upstream of said fifth, isolating valve means, whereby, by closing said fifth, isolating valve means, the purge gas may be allowed to accumulate in said vacuum chamber and in said third-stage pump.

8. The vacuum-pressure system according to claim 7, wherein said third, isolating valve means is coupled between the outlet of said second-stage pump and the inlet of said first-stage pump; said fourth. gas-recirculation valve means being coupled to said outlet of said second-stage pump upstream of said third, isolating valve means. whereby, when said third, isolating valve means is closed. and said fourth. gas-recirculation valve means is open, the purge gas may be allowed to recirculate through the vacuum chamber and the second-stage pump.

9. In a vacuum-pressure system comprising a vacuum chamber having an access-opening; a pumping system coupled to said access opening of said vacuum chamber for creating vacuum pressure in said vacuum chamber, said pumping system comprising at least one pump having an intake and an exhaust; first conduit means for coupling said pumping system to said access-opening of said vacuum chamber. said first conduit means having a first, isolating valve means coupled to said pumping system; means for injecting purge gas into said vacuum-pressure system in order to remove contamination from the interior of said vacuum chamber, said means for injecting purge gas comprising second conduit means for directing the purge gas into said vacuum-pressure system, said second conduit means having a second, isolating valve means for controlling the flow of the purge gas into said system, wherein the inprovement comprises:

a third, isolating valve means coupled to said exhaust of said at least one pump, and a fourth, gas-recirculation valve means coupled between said exhaust of said at least one pump and said vacuum chamber, whereby the purge gas may be recirculated through the vacuum chamber and said at least one pump a plurality of times, whereby said purge gas is heated by said at least one pump in order to remove contamination from the interior of the vacuum chamber;

said vacuum-pressure system being a high vacuum pressure system, said pumping system comprising a first-stage pump, a second-stage pump, and a third-stage, high-vacuum pump; said first, isolating valve means being located between the inlet of said third-stage, high-vacuum pump and said access opening of said vacuum chamber; and a fifth, isolating valve means located between the outlet of said third-stage pump and the inlet of said second-stage pump; said second, isolating valve means also being coupled to the outlet of said third-stage pump upstream of said fifth, isolating valve means, whereby, by closing said fifth, isolating valve means, the purge gas may be allowed to accumulate in said vacuum chamber and in said third-stage pump.

10. The vacuum-pressure system according to claim 9, wherein said at least one pump comprises a rotary gas compressor.

11. The vacuum-pressure system according to claim 10, wherein said rotary gas compressor comprises a dual, multi-lobe rotor, roots-type pump.

12. The vacuum-pressure System according to claim 9, wherein said first, isolating valve means is coupled to said intake of said at least one pump, said second, isolating valve means being coupled to a portion of said first conduit-means at a location upstream of said first, isolating valve means, so that first isolating valve means may isolate the purge gas to cause it to flow into said access-opening of said vacuum chamber.

13. The vacuum-pressure system according to claim 9, wherein said third, isolating valve means is coupled to the exhaust of said at least one pump; said fourth, gas-recirculation valve means being coupled to said exhaust of said at least one pump upstream of said third, isolating valve means, whereby, when said third, isolating valve means is closed, and said fourth, gas-recirculation valve means is open, the purge gas may be allowed to recirculate through the vacuum chamber.

14. The vacuum-pressure system according to claim 9, wherein said third, isolating valve means is coupled between the outlet of said second-stage pump and the inlet of said first-stage pump; said fourth, gas-recirculation valve means being coupled to said outlet of said second-stage pump upstream of said third, isolating valve means, whereby, when said third, isolating valve means is closed, and said fourth, gas-recirculation valve means is open, the purge gas may be allowed to recirculate through the vacuum chamber and the second-stage pump.

15. The vacuum-pressure system according to claim 14, wherein said fourth, gas-recirculating valve means comprises a gas-recirculating valve and third conduit means; said vacuum chamber comprising a second access-opening; said third conduit means having an end in fluid communication with said second access-opening of said vacuum chamber; said gas-recirculation valve means controlling the flow through said third conduit means and, therefore, the flow of purge gas into said second access-opening of said vacuum chamber.

16. In a vacuum-pressure system comprising a vacuum chamber having an access-opening; a pumping system coupled to said access opening of said vacuum chamber for creating vacuum pressure in said vacuum chamber, said pumping system comprising at least one pump having an intake and an exhaust; first conduit means for coupling said pumping system to said access-opening of said vacuum chamber, said first conduit means having a first, isolating valve means coupled to said pumping system; means for injecting purge gas into said vacuum-pressure system in order to remove contamination from the interior of said vacuum chamber, said means for injecting purge gas comprising second conduit means for directing the purge gas into said vacuum-pressure system, said second conduit means having a second, isolating valve means for controlling the flow of the purge gas into said system, wherein the improvement comprises:

a third, isolating valve means coupled to said exhaust of said at least one pump, and a fourth, gas-recirculation valve means coupled between said exhaust of said at least one pump and said vacuum chamber, whereby the purge gas may be recirculated through the vacuum chamber and said at least one pump a plurality of times, whereby said purge gas is heated by said at least one pump in order to remove contamination from the interior of the vacuum chamber;

said vacuum-chamber further comprising another access-opening, said another access-opening being coupled to said fourth, gas-recirculation valve means.

17. A method of heating purge gas for use in removing contaminants from a vacuum chamber of a vacuum system, which vacuum system comprises a pumping system having an inlet and an exhaust, said pumping system comprising at least one pump; purge-gas introducing means for introducing a purge gas into the vacuum system, said method comprising:

(a) introducing purge gas into the vacuum system until a desired volume has been introduced;

(b) directing the purge gas to the inlet of the pump so that the purge gas passes through the pump:

(c) directing the purge gas exiting from the outlet of the pump to and through the vacuum-chamber;

(d) said step (c) comprising preventing fluid communication between the outlet of the pump with the exhaust of the pumping system;

said step (b) heating the purge gas, whereby, upon its introduction into the vacuum chamber. contaminants therein are removed;

(e) returning the purge gas after said step (c) to the inlet of the pump for re-heating the gas as it passes therethrough from the inlet thereof to the outlet there of; and (f) fluidly coupling the outlet of the pump with the exhaust of the pumping system after said steps (a) through (e), in order to pump away the purge gas from the vacuum system;

said step (f) comprising preventing flow of the purge gas from the outlet of the pump to the vacuum-chamber.

18. The method of heating purge gas for use in removing contaminants from a vacuum chamber of a vacuum system, according to claim 17, further comprising:

(f) repeating said steps (b) and (c) at least one more time.

19. A method of heating purge gas for use in removing contaminants from a vacuum chamber of a vacuum system, which vacuum system comprises a pumping system having an inlet and an exhaust, said pumping system comprising at least one pump: purge-gas introducing means for introducing a purge gas into the vacuum system, said method comprising:

(a) introducing purge gas into the vacuum system until a desired volume has been introduced;

(b) directing the purge gas to the inlet of the pump so that the purge gas passes through the pump;

(c) directing the purge gas exiting from the outlet of the pump to and through the vacuum-chamber;

(d) said step (c) comprising preventing fluid communication between the outlet of the pump with the exhaust of the pumping system;

said step (b) heating the purge gas, whereby, upon its introduction into the vacuum chamber, contaminants therein are removed;

wherein the vacuum system comprises a first-stage pump, a second-stage pump, and a third-stage, high-vacuum pump whose outlet is capable of being coupled for fluid communication with the inlet of the second-stage pump; said step (a) comprising introducing the purge gas downstream of the third-stage pump, and preventing fluid communication between the outlet of the third-stage pump and the inlet of the second-stage pump in order to fill the interior of the vacuum chamber with the desired amount of purge gas; said step (b) comprising fluidly coupling the outlet of the third-stage pump to the inlet of the second-stage pump after said step (a).

20. A method of heating using a vacuum system, which vacuum system comprises a pumping system having an inlet and an exhaust, said pumping system comprising at least one pump; gas introducing means for introducing a gas into the vacuum system, said method comprising:

(a) introducing gas into the vacuum system until a desired volume has been introduced;

(b) directing the gas to the inlet of the pump so that the gas passes through the pump;

(c) directing the gas exiting from the outlet of the pump to a location utilizing the heat thereof;

(d) said step (c) comprising preventing fluid communication between the outlet of the pump with the exhaust of the pumping system;

said step (b) heating the gas;

wherein said step (c) comprises directing the exhaust gas along an extended conduit to the location where the heat emanating from the extended conduit is used for heating an interior volume exposed to the surface-area of the extended conduit.

21. A method of utilizing heat for doing work, comprising:

(a) directing the heated exhaust gas exiting from the outlet of a gas compressor apparatus to a location where the heat =rom the exhaust gas iS utilized for performing work;

(b) returning the exhaust gas from the location where said heat performed work to the inlet of the gas compressor apparatus for re-heating the gas as it passes through the gas compressor apparatus from the inlet thereof to the outlet thereof;

said step (a) comprising directing the exhaust gas into a vacuum chamber; and said step (b) comprises directing the exhaust gas from the vacuum chamber to the inlet of the gas compressor apparatus;

said step (a) further comprising directing the exhaust gas from a roots-type vacuum pump into the vacuum chamber; and said step (b) comprising directing the exhaust gas from the vacuum chamber to the inlet of the roots-type vacuum pump;

further comprising fluldly coupling the inlet of the roots-type pump to an outlet of a third-stage high-vacuum pump before said steps (a) and (b) are performed; said step (b) comprising passing the exhaust gas through the third-stage pump during its passage to the inlet of the roots-type pump.

22. In an apparatus comprising a chamber which is to be purged with purging gas for removing contaminants from the chamber walls, said chamber having an access-opening, said apparatus also comprising a pumping system coupled to said access opening of said chamber, said pumping system comprising at least one pump having an intake and an exhaust; first conduit means for coupling said pumping system to said access-opening of said chamber; means for injecting purge gas into said system in order to remove contamination from the interior of said chamber, said means for injecting purge gas comprising second conduit means for directing the purge gas into said system, said second conduit means having a first, isolating valve means for controlling the flow of the purge gas into said system, wherein the improvement comprises:

a second, isolating valve means coupled to said exhaust of said at least one pump, and a third, gas-recirculation valve means coupled between said exhaust of said at least one pump and said chamber upstream of said second valve means, whereby the purge gas may be recirculated through the chamber and said at least one pump a plurality of times. whereby said purge gas is heated by said at least one pump in order to remove contamination from the interior of the chamber.

23. In an apparatus comprising a chamber requiring periodic purging of contaminants therefrom, and having a gas inlet, and a gas outlet, the improvement comprising:

conduit means coupling said outlet to said inlet, for providing a closed-loop system, said conduit means recirculating the hot, exhausted gas from said outlet back into said inlet, whereby the exhausted gas is reheated during each recirculation;

said apparatus further comprising a rotary gas compressor comprising a stator, and at least one rotor mounted for rotation in said stator; said conduit means comprising a first conduit-section having a first end coupled to said outlet and a second end, and a second conduit-section having a first end coupled t.o said inlet and a second end;

a source of purge gas; and means operatively coupled to said source of purge gas for selectively introducing said purge gas into said conduit means when said chamber is to be purged; said means for selectively introducing said purge gas comprising valve means for allowing said purge gas to flow into said conduit means when said chamber is to be purged, and for preventing said purge gas from flowing into said conduit means after said chamber has been purged, whereby after said purge gas is prevented from flowing into said conduit means by said means for selectively introducing said purge gas, said gas compressor will pump out the purge gas and the contaminants purged from the walls of the chamber to the ambient.

* * * * *